US007104762B2

(12) United States Patent
Dausacker et al.

(10) Patent No.: US 7,104,762 B2
(45) Date of Patent: Sep. 12, 2006

(54) REDUCED WEIGHT CONTROL STAGE FOR A HIGH TEMPERATURE STEAM TURBINE

(75) Inventors: Paul Walter Dausacker, Saratoga Springs, NY (US); Robert Edward Deallenbach, Schenectady, NY (US); Allyn Keith Holliday, Rotterdam Junction, NY (US)

(73) Assignee: General Electric Company, Schenectady, NY (US)

( * ) Notice: Subject to any disclaimer, the term of this patent is extended or adjusted under 35 U.S.C. 154(b) by 325 days.

(21) Appl. No.: 10/470,637

(22) Filed: Jan. 6, 2004

(65) Prior Publication Data

US 2005/0238492 A1 Oct. 27, 2005

(51) Int. Cl.
*F01D 5/30* (2006.01)
*F01D 5/18* (2006.01)

(52) U.S. Cl. ..... 416/232; 416/248

(58) Field of Classification Search ..... 415/115; 416/95, 96 R, 232, 222, 248
See application file for complete search history.

(56) References Cited

U.S. PATENT DOCUMENTS 2,639,119 A * 5/1953 Greenwald ..... 416/217
4,142,824 A * 3/1979 Andersen ..... 415/115
5,062,769 A * 11/1991 Ortolano ..... 416/217
6,923,616 B1 * 8/2005 McRae et al. ..... 415/115

* cited by examiner

*Primary Examiner*—Ninh H. Nguyen
(74) *Attorney, Agent, or Firm*—Nixon & Vanderhye, P.C.

(57) ABSTRACT

The control stage buckets for a steam turbine have airfoils which are hollowed out to form an interior cavity within the airfoil. The cavity opens through the radial inner platform of the bucket and terminates short of the tip of the bucket. The buckets are therefore of reduced weight. This reduced weight causes reduced creep damage in the axially extending dovetails along the rotor rim.

14 Claims, 2 Drawing Sheets

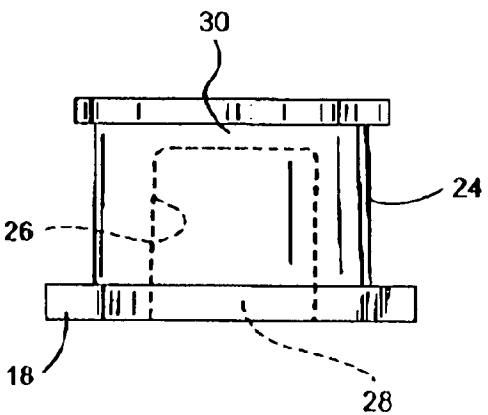
Fig. 5
Fig. 1
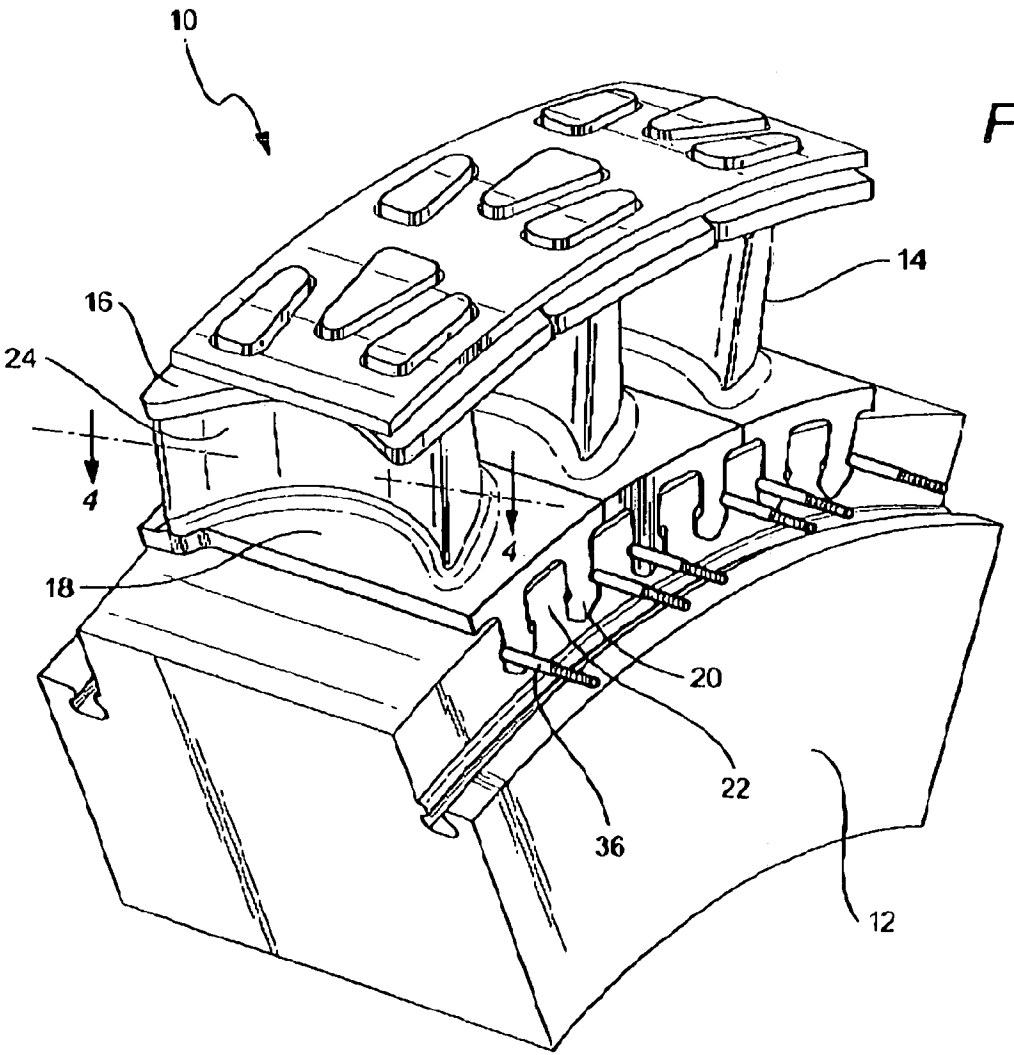

REDUCED WEIGHT CONTROL STAGE FOR A HIGH TEMPERATURE STEAM TURBINE

BACKGROUND OF THE INVENTION

The present invention relates to a control stage for a high temperature steam turbine and particularly relates to buckets of the control stage having internal cavities within the airfoils of the buckets to reduce the weight of the bucket and creep damage in the turbine rotor.

The control stage of a steam turbine, i.e., the first stage of the turbine downstream of the control valves and steam inlets, creates unique loading on the control stage buckets. Typically, there are four inlets for admitting steam to the control stage, with a control valve for each inlet. The inlets are generally arranged in quadrants. Consequently, steam is emitted over segments of arcs and is therefore not uniformly applied on the first stage bucket airfoils. Because of this unique non-uniform flow and, hence, loading on the control stage, and over long-term operation at high temperatures, creep damage can and does occur in the turbine rotor, particularly in the coupling between the buckets and the rotor.

Typically, the buckets are secured to the rotor by dovetails. For example, the buckets may have first are second dovetails extending in an axial direction. Alternate dovetails on the rotor are received between the first and second bucket dovetails. The remaining rotor dovetails are received between the bucket dovetails of next-adjacent bucket. The rotor is typically formed of a material which does not have the high creep or rupture strength characteristic of the creep or rupture strength of the buckets end, accordingly, creep damage can and does occur about the rotor dovetails. Conventionally, the dovetails of the bucket and rotor are secured to one another by insertion of axially extending crush pins in openings formed in both the bucket and rotor dovetails. Creep strains around the pinholes of the dovetails, particularly in neck regions of the rotor dovetails, have been demonstrated. Accordingly, there is a need to control the loads or stresses in those regions to prevent creep strain from causing cracks to develop in the rotor dovetail.

BRIEF DESCRIPTION OF THE INVENTION

In accordance with a preferred aspect of the present invention, the airfoil of each bucket is provided with an interior cavity thereby reducing the weight of the bucket and subsequent centrifugal loading on the rotor during operation. More particularly, the reduced weight of the bucket reduces the creep strain on the rotor dovetails during long-term centrifugal and high temperature loading on the turbine rotor. Particularly, the interior cavity of the bucket extends through the bucket platform and substantially throughout the entire length of the airfoil, terminating adjacent the airfoil tip. The cavity is closed adjacent the tip of the airfoil and remains open at the platform. The cavity may have a generally airfoil-shaped interior surface corresponding generally to the external profile of the airfoil with due consideration being given to the necessary strength of the airfoil. The cavity may, however, be otherwise shaped. By reducing the weight of the bucket, the long-term creep damage on the rotor dovetail is minimized or eliminated.

In a preferred embodiment according to the present invention, there is provided a reduced weight control stage for a steam turbine comprising a steam turbine bucket having an airfoil, a platform and a first dovetail for attaching the bucket to a generally correspondingly shaped rotor dovetail, the airfoil having an interior cavity extending between the platform to a location adjacent a tip of the airfoil enabling a reduction in the weight of the bucket for reducing creep damage along the rotor dovetail.

In a further preferred embodiment according to the present invention, there is provided a reduced weight control stage for a steam turbine comprising a rotor having a plurality of dovetails projecting radially outwardly of the rim of the rotor and extending generally axially, a plurality of buckets each having an airfoil, a platform and first and second dovetails projecting radially inwardly of the platform and defining a generally axially extending space therebetween for receiving one of the rotor dovetails, each airfoil having an interior cavity extending through the platform to a location adjacent a tip of the airfoil enabling a reduction in the weight of the bucket for reducing creep damage along the rotor dovetail between the first and second bucket dovetails.

BRIEF DESCRIPTION OF THE DRAWINGS

FIG. 1 is perspective view of a portion of a rotor with the bucket secured thereto;

FIG. 5 is a side elevational view of the airfoil portion of the bucket illustrating the extent of the cavity within the airfoil.

DETAILED DESCRIPTION OF THE INVENTION

Figure 4:
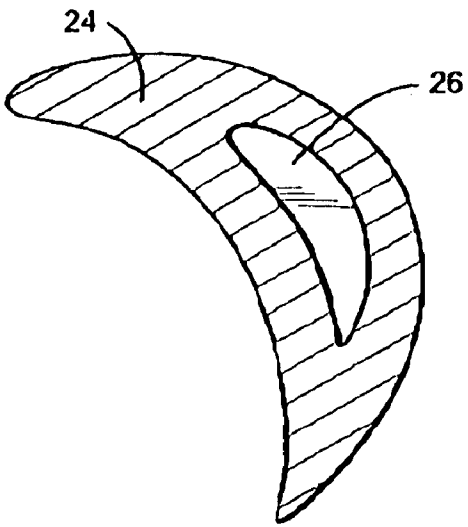
FIG. 4 is a cross-sectional view through a midpoint of the airfoil illustrating the interior cavity within the steam turbine airfoil.
Figure 3:
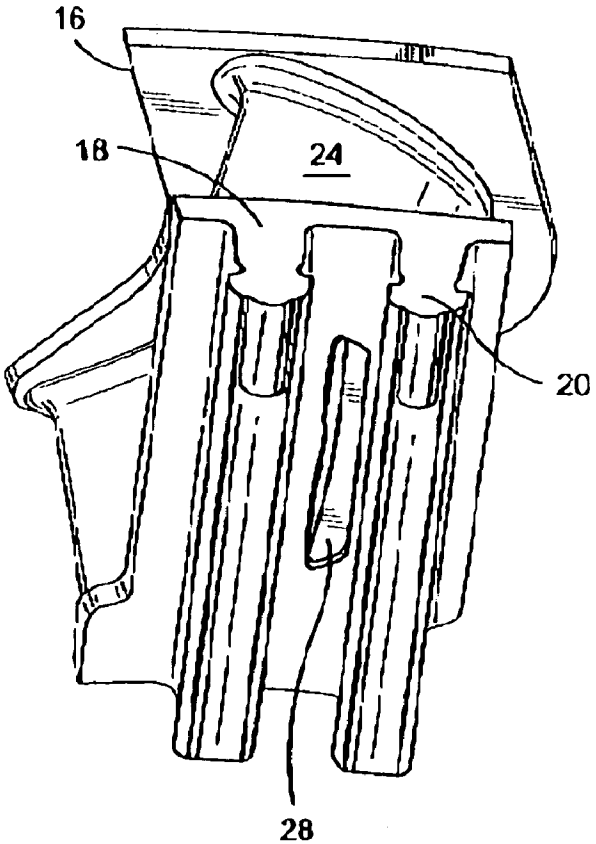
FIG. 3 is a view similar to FIG. 2 illustrating the opening in the platform after the cavity has been formed.

Referring now to the drawings, particularly to FIG. 1, there is illustrated a portion of a control stage, generally designated 10, for a steam turbine including a rotor 12 and a plurality of buckets 14. Each bucket 14 includes an outer band 16, an inner band or platform 18, one or more and preferably a pair of radially inwardly extending dovetails 20, and an airfoil 24. The dovetails 20 extend axially and are spaced one from the other in a circumferential direction. The rotor 12 includes a plurality of generally correspondingly shaped dovetails 22 which likewise extend in an axial direction. The axially extending dovetails 20 of the buckets 14 are axially inserted onto the rim of the rotor with the dovetails 20 straddling alternate dovetails 22 of the rotor 12. The circumferentially adjacent dovetails 20 of adjacent buckets likewise straddle the adjacent dovetails 22 or the rotor. It will be appreciated that the materials forming the rotor typically have reduced creep or rupture strength relative to the materials forming the buckets. For example, the rotor may be formed of a chrome molly vanadium while the buckets may be formed of 12 chrome. Consequently, creep damage may occur in the rotor dovetails 22, particularly in the neck portions of the dovetails 22. Creep damage may lead to cracking in the rotor dovetails.

To minimize or eliminate the creep damage in the turbine rotor during long term operation under high temperature and centrifugal loading, the steam turbine buckets 14 have their airfoils 24 formed of reduced weight. To accomplish this, cavities are formed in the interiors of the airfoils 24. For example, referring to FIGS. 4 and 5, a cavity 26 is formed within the airfoil 24. As illustrated, the cavity 26 opens through an aperture 28 formed in the platform 18 and terminates short of the tip 30 of the airfoil 24. While the cavity 26 need not have any particular shape, the cavity may have an airfoil shape generally corresponding to the external profile of the airfoil 24 as best illustrated in FIG. 4.

Figure 2:
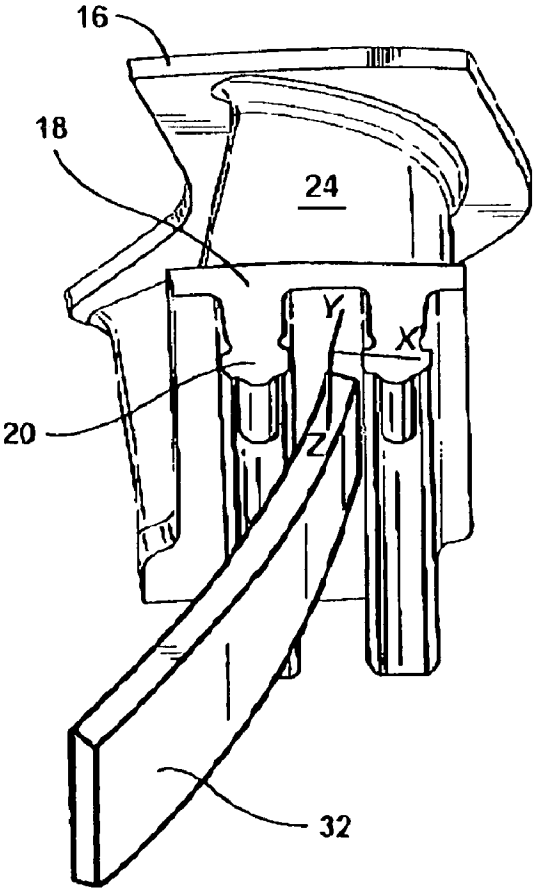
FIG. 2 is a perspective view of the underside of a bucket illustrating the insertion of a tool for forming a cavity within the airfoil of the bucket.

In order to form the cavity 26 within the airfoil, the airfoil is hollowed out using an Electro-Discharging Machining (EDM) or Electro-Chemical Machining (ECM) processes. For example, an EDM tool 32 (FIG. 2) may be applied to the underside of the platform 18 between the bucket dovetails 20 to form the aperture 28 through the platform 18. Further insertion of the EDM tool 32 through the aperture 28 of the platform is used to hollow out the interior of the airfoil 24. As a consequence of the formation of an interior cavity within the airfoil, the weight of the bucket is significantly reduced. It will be appreciated that a predetermined wall thickness of the airfoil is maintained to provide adequate strength to the airfoil.

Referring to FIG. 1, the buckets are secured to the rotor in a conventional fashion. That is, the buckets are slidable in an axial direction to engage and straddle alternating dovetails 22 on the rotor rim. The remaining rotor dovetails are disposed between the adjacent dovetails of adjacent buckets. To secure the rotor and bucket dovetails to one another, cylindrical holes are formed, e.g., by reaming, between the adjacent dovetails of the buckets and rotor after the buckets have been axially inserted onto the rotor. Pins 36 are then inserted into the reamed holes at very close or tight tolerances to form a perfect fit with the holes. The buckets are therefore essentially pinned into the rotor wheel with very little or no relative movement between the buckets and wheel. With partial-arc loading, the pin connection reduces any potential for wear and fretting between the bucket and rotor. With this construction, it will be appreciated that the apertures 28 through the platform 18 lie in opposition to the alternating dovetails 22 of the rotor wheel rim. With this arrangement, steam may enter the cavities 26. However, since there is no exit for the steam from each cavity, the steam entering the cavity is not significant to the operation of the turbine.

From the foregoing description, it will be appreciated that with each of the buckets having a substantial mass of material removed, i.e., hollowed out to form the cavity 26 within the airfoil of each bucket, as well as the platform, the buckets are reduced in weight. This reduces the centrifugal loading on the rim of the rotor and particularly on the reduced necks of the rotor rim dovetails 22. Consequently, creep loading adjacent the neck portions of the rotor dovetails 22 is minimized. In a particular preferred embodiment, each control stage bucket for a steam turbine is reduced in both weight and volume in comparison with the identical bucket without the interior cavity formed therein as in the present invention. Particularly, the weight of the control stage bucket is reduced by about 10%. This reduction in weight significantly reduces the centrifugal loading on the rotor. The volume of each control stage bucket is likewise reduced by about 10%. This is particularly significant in the control stage of a steam turbine where non-uniform flow or partial-arc flow occurs on the first stage buckets. This essentially pulsating flow increases the likelihood of increased creep strains which are more than offset by the reduction in weight of the buckets enabling reduction or elimination of the creep strain damage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A reduced weight control stage for a steam turbine comprising:

a steam turbine bucket having an airfoil, a platform and first and second circumferential spaced dovetails for attaching the bucket to a generally correspondingly shaped rotor dovetail;

said airfoil having an interior cavity extending through said platform between said first and second dovetails to a location short of a tip of the airfoil enabling a reduction in the weight of the bucket for reducing creep damage along the rotor dovetail.

2. A control stage according to claim 1 wherein said cavity opens through said platform.

3. A control stage according to claim 1 wherein said cavity has a generally airfoil shape corresponding generally to the external profile of said airfoil.

4. A control stage according to claim 1 wherein said bucket has a weight about 10% less than the weight of an identical bucket formed without said cavity.

5. A control stage according to claim 1 wherein said bucket has a volume about 10% less than the volume of an identical bucket formed without said cavity.

6. A reduced weight control stage for a steam turbine comprising:

a rotor having a plurality of dovetails projecting radially outwardly of the rim of the rotor and extending generally axially;

a plurality of buckets each having an airfoil, a platform and first and second dovetails projecting radially inwardly of said platform and defining a generally axially extending space therebetween for receiving one of the rotor dovetails;

each said airfoil having an interior cavity extending through said platform to a location adjacent a tip of the airfoil enabling a reduction in the weight of the bucket for reducing creep damage along the rotor dovetail between the first and second bucket dovetails, and wherein the bucket and rotor are formed of materials such that the rotor dovetail has reduced creep strength in relation to the creep strength of the bucket.

7. A control stage according to claim 6 wherein said cavity for each said airfoil opens through said platform.

8. A control stage according to claim 6 wherein said cavity for each said airfoil terminates short of said airfoil tip.

9. A control stage according to claim 8 wherein said cavity for each said airfoil opens through said platform.

10. A control stage according to claim 6 wherein each said cavity has a generally airfoil shape corresponding generally to the external profile of said airfoil.

11. A control stage according to claim 10 wherein said cavity for each said airfoil terminates short of said airfoil tip, said cavity for each said airfoil opening through said platform.

12. A control stage according to claim 6 wherein the bucket is formed of twelve chrome and the rotor wheel is formed of chrome molly vanadium.

13. A control stage according to claim 6 wherein each said bucket has a weight about 10% less than the weight of an identical bucket formed without said cavity.

14. A control stage according to claim 6 wherein said bucket has a volume about 10% less than the volume of an identical bucket formed without said cavity.

* * * * *

UNITED STATES PATENT AND TRADEMARK OFFICE

CERTIFICATE OF CORRECTION

PATENT NO. : 7,104,762 B2
APPLICATION NO. : 10/470637
DATED : September 12, 2006
INVENTOR(S) : Dausacker et al.

It is certified that error appears in the above-identified patent and that said Letters Patent is hereby corrected as shown below:

Column 1, line 25, delete “are” and insert --and--.

Column 1, line 29, delete “bucket” and insert --buckets--.

Column 1, line 32, delete “end’ and insert --and--.

Column 2, line 22, insert --a-- after “FIG. 1 is”.

Column 2, line 53, delete “or” and insert --of--.

Signed and Sealed this

Nineteenth Day of December, 2006

JON W. DUDAS
*Director of the United States Patent and Trademark Office*